US011028694B2

(12) United States Patent
Frasinel et al.

(10) Patent No.: US 11,028,694 B2
(45) Date of Patent: Jun. 8, 2021

(54) VALVE TRAIN FOR OPPOSED-PISTON FOUR-STROKE ENGINE

(71) Applicant: AVL Powertrain Engineering, Inc., Plymouth, MI (US)

(72) Inventors: Vasile Frasinel, Windsor (CA); Jennifer Weiche, Plymouth, MI (US)

(73) Assignee: AVL Powertrain Engineering, Inc., Plymouth, MI (US)

( * ) Notice: Subject to any disclaimer, the term of this patent is extended or adjusted under 35 U.S.C. 154(b) by 268 days.

(21) Appl. No.: 16/135,871

(22) Filed: Sep. 19, 2018

(65) Prior Publication Data

US 2019/0093479 A1 Mar. 28, 2019

Related U.S. Application Data

(60) Provisional application No. 62/564,044, filed on Sep. 27, 2017.

(51) Int. Cl.
*F01B 7/14* (2006.01)
*F02B 75/28* (2006.01)
(Continued)

(52) U.S. Cl.
CPC ..... *F01B 7/14* (2013.01); *F01L 1/026* (2013.01); *F01L 1/047* (2013.01); *F01L 1/181* (2013.01);
(Continued)

(58) Field of Classification Search
CPC ..... F01B 7/14; F01B 7/02; F01L 1/047; F01L 1/181; F01L 1/026; F01L 2305/00;
(Continued)

(56) References Cited

U.S. PATENT DOCUMENTS 530,523 A * 12/1894 Hirsch ..... F02B 75/28 123/51 R
1,090,650 A * 3/1914 Richardson ..... F04B 3/00 92/65
(Continued)

FOREIGN PATENT DOCUMENTS

DE 588722 C 11/1933
DE 3002412 A1 4/1982
(Continued)

OTHER PUBLICATIONS

U.S. Appl. No. 16/135,813, filed Sep. 19, 2018, Vasile Frasinel.
(Continued)

*Primary Examiner* — Grant Moubry
*Assistant Examiner* — James G Moubry
(74) *Attorney, Agent, or Firm* — Honigman LLP; Matthew H. Szalach

(57) ABSTRACT

An opposed-piston engine includes an engine block, at least two intake valves, and at least two exhaust valves. The engine block includes a first center section and a second center section. The first center section defines a first cylinder half bore having a first longitudinal axis and a first open end. The second center section defines a second cylinder half bore having a second longitudinal axis and a second open end. The second longitudinal axis is offset from the first longitudinal axis. The first and second open ends overlap to form and opening therebetween that places the first and second cylinder half bores in fluid communication with one another to form a single cylinder. The intake valves are arranged at the first open end of the first cylinder half bore. The exhaust valves are arranged at the second open end of the second cylinder half bore.

12 Claims, 7 Drawing Sheets

(51) Int. Cl.

| | |
|---|---|
| ***F02F 1/00*** | (2006.01) |
| ***F02F 1/22*** | (2006.01) |
| ***F02F 1/18*** | (2006.01) |
| ***F01L 1/047*** | (2006.01) |
| ***F01L 1/18*** | (2006.01) |
| ***F01L 1/02*** | (2006.01) |
| *F01L 1/053* | (2006.01) |

(52) U.S. Cl.
CPC ..... *F02B 75/282* (2013.01); *F02F 1/004* (2013.01); *F02F 1/186* (2013.01); *F02F 1/22* (2013.01); *F01L 2001/054* (2013.01); *F01L 2001/0537* (2013.01); *F01L 2305/00* (2020.05); *F01L 2820/01* (2013.01); *F01L 2820/02* (2013.01)

(58) Field of Classification Search
CPC ..... F01L 2001/054; F01L 2001/0237; F01L 2820/02; F01L 2820/01; F01L 2003/251; F02B 75/282; F02B 75/28; F02F 1/004; F02F 1/22; F02F 1/186
See application file for complete search history.

(56) References Cited

U.S. PATENT DOCUMENTS

| | | | | | |
|---|---|---|---|---|---|
| 1,703,752 | A | | 2/1929 | Reineke | |
| 4,554,894 | A | * | 11/1985 | Johnson | F02B 75/24 123/198 E |
| 5,163,390 | A | * | 11/1992 | Shimamoto | F01L 1/181 123/432 |
| 5,477,818 | A | * | 12/1995 | Ascari | F02B 73/00 123/51 AA |
| 5,596,955 | A | * | 1/1997 | Szuba | F01L 5/04 123/51 AA |
| 6,250,263 | B1 | | 6/2001 | Sisco | |
| 7,086,371 | B2 | | 8/2006 | Sanada et al. | |
| 2010/0212637 | A1 | | 8/2010 | Lemke et al. | |
| 2010/0212638 | A1 | | 8/2010 | Rado et al. | |
| 2014/0318518 | A1 | | 10/2014 | Jeswine | |
| 2016/0032823 | A1 | | 2/2016 | McClearen et al. | |
| 2016/0032861 | A1 | | 2/2016 | Fuqua | |
| 2016/0252043 | A1 | | 9/2016 | McClearen et al. | |
| 2016/0252044 | A1 | | 9/2016 | McClearen et al. | |
| 2019/0093478 | A1 | | 3/2019 | Frasinel | |

FOREIGN PATENT DOCUMENTS

| | | | |
|---|---|---|---|
| DE | 69017614 | T2 | 7/1995 |
| DE | 102012024177 | A1 | 6/2014 |
| GB | 360496 | A | 11/1931 |

OTHER PUBLICATIONS

Search Report corresponding to German Patent Application No. 10 2018 123 685.9 dated Apr. 28, 2020, 11 pages.
Search Report corresponding to German Patent Application No. 10 2018 123 678.6 dated Apr. 24, 2020, 13 pages.

* cited by examiner

VALVE TRAIN FOR OPPOSED-PISTON FOUR-STROKE ENGINE

CROSS-REFERENCE TO RELATED APPLICATIONS

This application claims the benefit of U.S. Provisional Application No. 62/564,044, filed on Sep. 27, 2017. The entire disclosure of the application referenced above is incorporated herein by reference.

FIELD

The present disclosure relates to valve trains for opposed-piston four-stroke engines.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An opposed-piston engine includes an engine block defining one or more cylinders, a pair of pistons disposed within each cylinder, a crankshaft connected to each of the pistons, and one or more fuel injectors that inject fuel into each cylinder. Combustion of an air/fuel mixture within the cylinder causes the pistons to translate toward one another and away from one another, which drives rotation of the crankshaft. The engine block also defines an intake port that allows intake air to enter the cylinder, and an exhaust port that allow exhaust gas to be expelled from the cylinder.

In an opposed-piston two-stroke (OP2S) engine, the intake and exhaust ports typically extend through the sidewall of each cylinder and are disposed near opposite ends of the cylinder. When the pistons pass the intake and exhaust ports as the pistons are moving away from each other during a combustion or power stroke, intake air is drawn through the intake port while exhaust gas is expelled through the exhaust port. When the pistons pass the intake and exhaust ports as the pistons are moving toward each other during a compression stroke, the pistons prevent flow through the intake and exhaust ports. Since movement of the pistons controls flow through the intake and exhaust ports, there is no need for intake or exhaust valves.

Some opposed-piston four-stroke (OP4S) engines also control flow through the intake and exhaust ports using piston movement rather than intake and exhaust valves. In such an OP4S engine, intake air is drawn into the cylinder and exhaust gas is expelled from the cylinder at different times. Intake air is drawn into the cylinder when the pistons pass the intake and exhaust ports as the pistons move away from each other during an intake stroke. Fuel is injected into the cylinder, and the air/fuel mixture is compressed as the pistons move toward each other during a compression stroke. This compression causes the air/fuel mixture to ignite, and the combustion pressure urges the pistons to move away from each other during a combustion or power stroke. The pistons once again pass the intake and exhaust ports, and exhaust gas is expelled from the cylinder as the pistons move toward each other during an exhaust stroke.

Controlling flow through the intake and exhaust ports using piston movement limits the ability to adjust the timing and amount of flow through the intake and exhaust ports relative to controlling flow through the intake and exhaust ports using intake and exhaust valves. While attempts have been made to design an OP4S engine that controls flow through the intake and exhaust ports using intake and exhaust valves, the attempts have resulted in cost, manufacturing, assembly, serviceability, and performance issues.

SUMMARY

An example of an opposed-piston engine according to the present disclosure includes an engine block, at least two intake valves, and at least two exhaust valves. The engine block includes a first center section and a second center section. The first center section defines a first cylinder half bore having a first longitudinal axis and a first open end. The second center section defining a second cylinder half bore having a second longitudinal axis and a second open end. The second longitudinal axis of the second cylinder half bore is offset from the first longitudinal axis of the first cylinder half bore. The second open end of the second cylinder half bore overlaps the first open end of the first cylinder half bore to form an opening between the first and second cylinder half bores. The opening places the first and second cylinder half bores in fluid communication with one another to form a single cylinder. The at least two intake valves are arranged at the first open end of the first cylinder half bore. The at least two exhaust valves are arranged at the second open end of the second cylinder half bore.

In one example, the at least two intake valves includes three intake valves, and the at least two exhaust valves includes three exhaust valves.

In one example, the size of each of the exhaust valves is equal to the size of each of the intake valves.

In one example, the opposed-piston engine further includes a single intake camshaft that actuates all of the intake valves, and a single exhaust camshaft that actuates all of the exhaust valves.

In one example, all of the intake valves have the same lift profile, and all of the exhaust valves have the same lift profile.

In one example, the opposed-piston engine further includes an intake rocker arm shaft, first intake rocker arms pivotally mounted on the intake rocker arm shaft and configured to open first and second ones of the intake valves when the first intake rocker arms engage first lobes on the intake camshaft, a second intake rocker arm pivotally mounted on the intake rocker arm shaft and configured to open a third one of the intake valves when the first intake rocker arms engage a second lobe on the intake camshaft, an exhaust rocker arm shaft, first exhaust rocker arms pivotally mounted on the exhaust rocker arm shaft and configured to open first and second ones of the exhaust valves when the first exhaust rocker arms engage first lobes on the exhaust camshaft, and a second exhaust rocker arm pivotally mounted on the exhaust rocker arm shaft and configured to open a third one of the exhaust valves when the first exhaust rocker arms engage a second lobe on the exhaust camshaft.

In one example, the first and second intake valves are located a first distance from the intake rocker arm shaft, the third intake valve is located a second distance from the intake camshaft that is different than the first distance, the first and second exhaust valves are located a third distance from the exhaust rocker arm shaft, and the third exhaust valve is located a fourth distance from the exhaust rocker arm shaft that is different than the third distance.

In one example, the second distance is less than the first distance, and the fourth distance is less than the third distance.

In one example, each of the first intake rocker arms has a first length, the second intake rocker arm has a second length that is less than the first length of each of the first intake rocker arms, each of the first exhaust rocker arms has a third length, and the second exhaust rocker arm has a fourth length that is less than the third length of each of the first exhaust rocker arms.

In one example, each of the first lobes on the intake camshaft has a first height, the second lobe on the intake camshaft has a second height that is greater than the first height, each of the first lobes on the exhaust camshaft has a third height, and the second lobe on the exhaust camshaft has a fourth height that is greater than the third height.

In one example, the intake valves include stems that are oriented parallel to the first longitudinal axis of the first cylinder half bore, and the exhaust valves include stems that are oriented parallel to the second longitudinal axis of the second cylinder half bore.

In one example, the opposed-piston engine further includes a first fuel injector positioned at or near the first longitudinal axis of the first cylinder half bore and a second fuel injector positioned at or near the first longitudinal axis of the second cylinder half bore, the intake valves are positioned around the first fuel injector along an outer perimeter of the first cylinder half bore, and the exhaust valves are positioned around the second fuel injector along an outer perimeter of the second cylinder half bore.

In one example, the first and second center sections are formed separate from one another.

Another example of an opposed-piston engine according to the present disclosure includes an engine block, M intake valves, and N exhaust valves. The engine block includes a first center section and a second center section. The first center section defines a first cylinder half bore having a first longitudinal axis and a first open end. The second center section defines a second cylinder half bore having a second longitudinal axis and a second open end. The second longitudinal axis of the second cylinder half bore is offset from the first longitudinal axis of the first cylinder half bore. The second open end of the second cylinder half bore overlaps the first open end of the first cylinder half bore to form an opening between the first and second cylinder half bores. The opening places the first and second cylinder half bores in fluid communication with one another to form a single cylinder. The M intake valves are arranged at the first open end of the first cylinder half bore and configured to control the flow of intake air into the cylinder. The N exhaust valves arranged at the second open end of the second cylinder half and configured to control the flow of exhaust gas out of the cylinder. M and N are integers greater than one, and N is equal to M.

In one example, M and N are each equal to three.

In one example, the size of each of the exhaust valves is equal to the size of each of the intake valves.

In one example, the opposed-piston engine further includes a single intake camshaft that actuates all of the intake valves, and a single exhaust camshaft that actuates all of the exhaust valves.

Another opposed-piston engine according to the present disclosure includes an engine block, a rocker arm shaft, first and second rocker arms, a first valve (e.g., an intake valve or an exhaust valve), and a second valve (e.g., an intake valve or an exhaust valve). The engine block includes a first center section and a second center section. The first center section defines a first cylinder half bore having a first longitudinal axis and a first open end. The second center section defines a second cylinder half bore having a second longitudinal axis and a second open end. The second longitudinal axis of the second cylinder half bore is offset from the first longitudinal axis of the first cylinder half bore. The second open end of the second cylinder half bore overlaps the first open end of the first cylinder half bore to form an opening between the first and second cylinder half bores. The opening places the first and second cylinder half bores in fluid communication with one another to form a single cylinder. At least one of the first and second center sections defining a rocker arm shaft bore. The rocker arm shaft is received in the rocker arm shaft bore. The first and second rocker arms are pivotally mounted to the rocker arm shaft. The first valve is arranged at the first open end of the first cylinder half bore, actuated by the first rocker arm, and located a first distance from the rocker arm shaft. The second valve is arranged at the first open end of the first cylinder half bore, actuated by the second rocker arm, and located a second distance from the rocker arm shaft that is different than the first distance.

In one example, the opposed-piston engine further includes a third rocker arm pivotally mounted on the rocker arm shaft, and a third valve arranged at the first open end of the first cylinder half bore, actuated by the second rocker arm, and located the first distance from the rocker arm shaft.

In one example, the second distance is less than the first distance.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
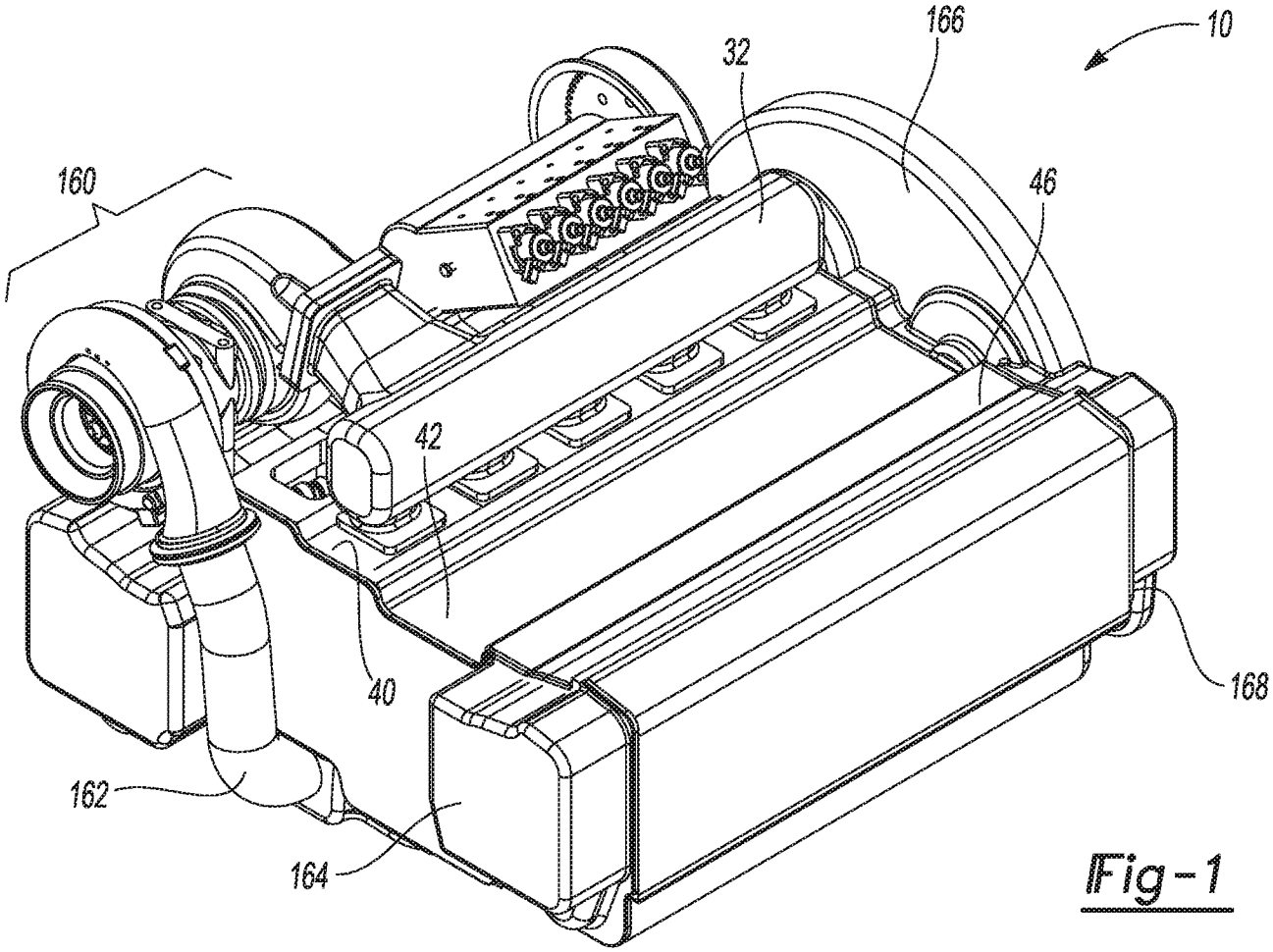
FIG. 1 is a perspective view of an opposed-piston four-stroke (OP4S) engine including a valve train according to the present disclosure.

In an effort to improve the volumetric efficiency of an engine and thereby improve the power output and fuel efficiency of the engine, attempts have been made to increase the number of intake and exhaust valves per cylinder. For example, in some engines that have a single piston disposed within each cylinder and a cylinder head closing off the open end of each cylinder, the number of intake and exhaust valves per cylinder has been increased to four or five valves per cylinder (e.g., two intake valves per cylinder and two exhaust valves per cylinder). However, the gas exchange in these types of engines is not as efficient as possible since intake air and exhaust gas flows into and out of each cylinder in opposite directions. Thus, the difference in volumetric efficiency between a cylinder-head engine with two intake valves per cylinder and a cylinder-head engine with three intake valves per cylinder is relatively small and may be offset by the cost and reliability concerns of adding an intake valve to each cylinder.

As indicated above, attempts have been made to design an OP4S engine that controls flow through the intake and exhaust ports using intake and exhaust valves. In these OP4S engines, each cylinder of the OP4S engine is split into two halves, and the two cylinder half bores are offset relative to each other to provide packaging space for valve trains. These OP4S engines provide a more efficient gas exchange process relative to cylinder-head engines since intake air and exhaust gas flows into and out of each cylinder in the same direction. However, the number and arrangement of the intake and exhaust valves in the OP4S engine have not been optimized to maximize volumetric efficiency or to provide the most improvement in the gas exchange process.

An OP4S engine according to the present disclosure includes three or more intake valves arranged at the open end of a first cylinder half bore, and the same number and size (e.g., disk diameter) of exhaust valves arranged at the open end of a second cylinder half bore. The first and second cylinder half bores are in fluid communication with one another to form a single cylinder. The OP4S engine may have multiple cylinders and therefore may include multiple pairs of the first and second cylinder half bores.

The equal number and size of the intake and exhaust valves allows for an efficient gas exchange process while using a robust valve actuation mechanism. The separation of the intake and exhaust valves on opposite sides of the OP4S engine allows flexibility in the size and position of the valves on either side. In addition, compared to cylinder-head engines, the difference in volumetric efficiency between an OP4S engine with two intake valves per cylinder and an OP4S engine with three intake valves per cylinder is significant. Thus, the difference in volumetric efficiency realized by adding an intake valve to each cylinder of an OP4S engine likely outweighs the cost and reliability concerns of adding an intake valve to each cylinder of an OP4S engine.

Figure 2:
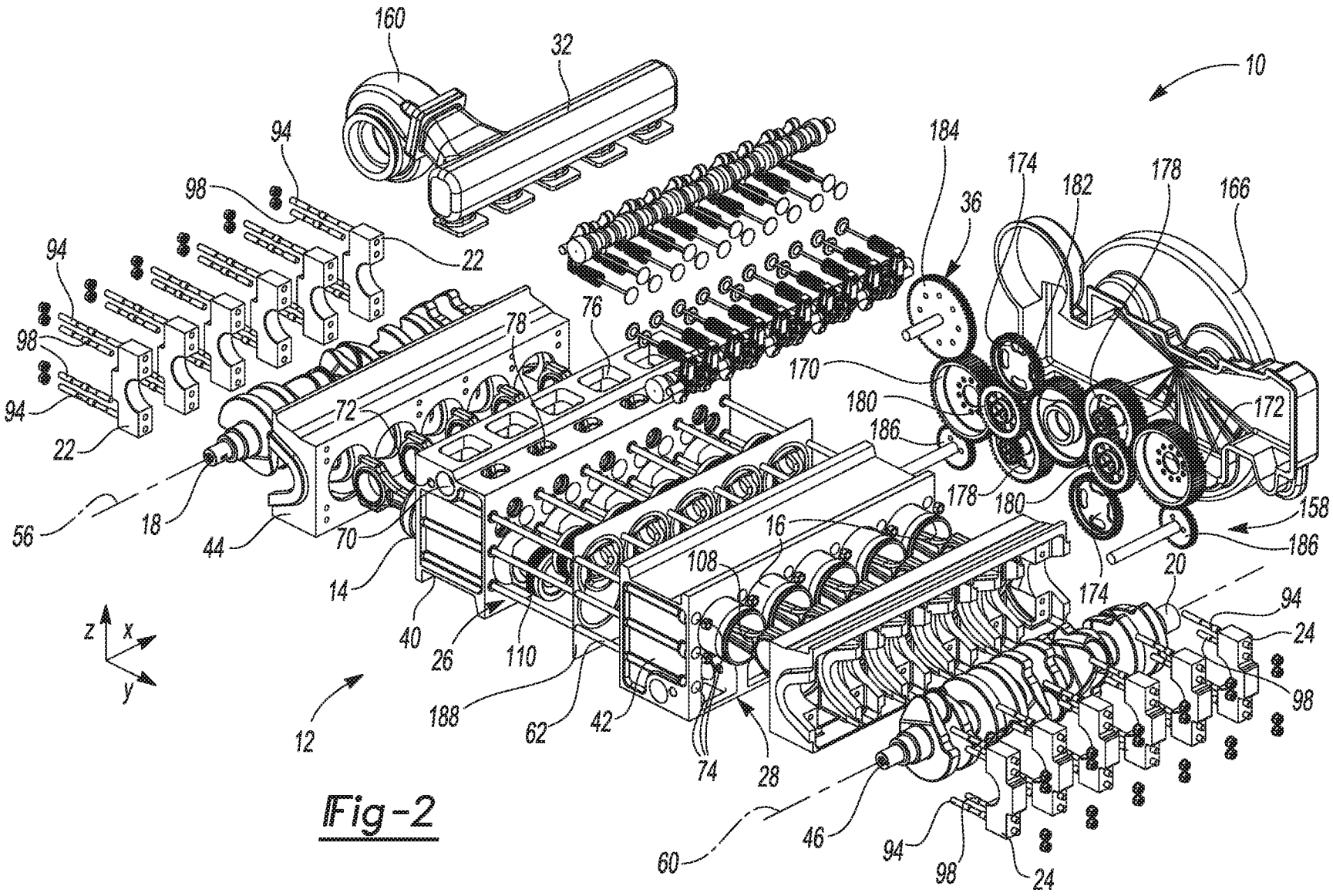
FIG. 2 is an exploded perspective view the OP4S engine of FIG. 1.
Figure 3:
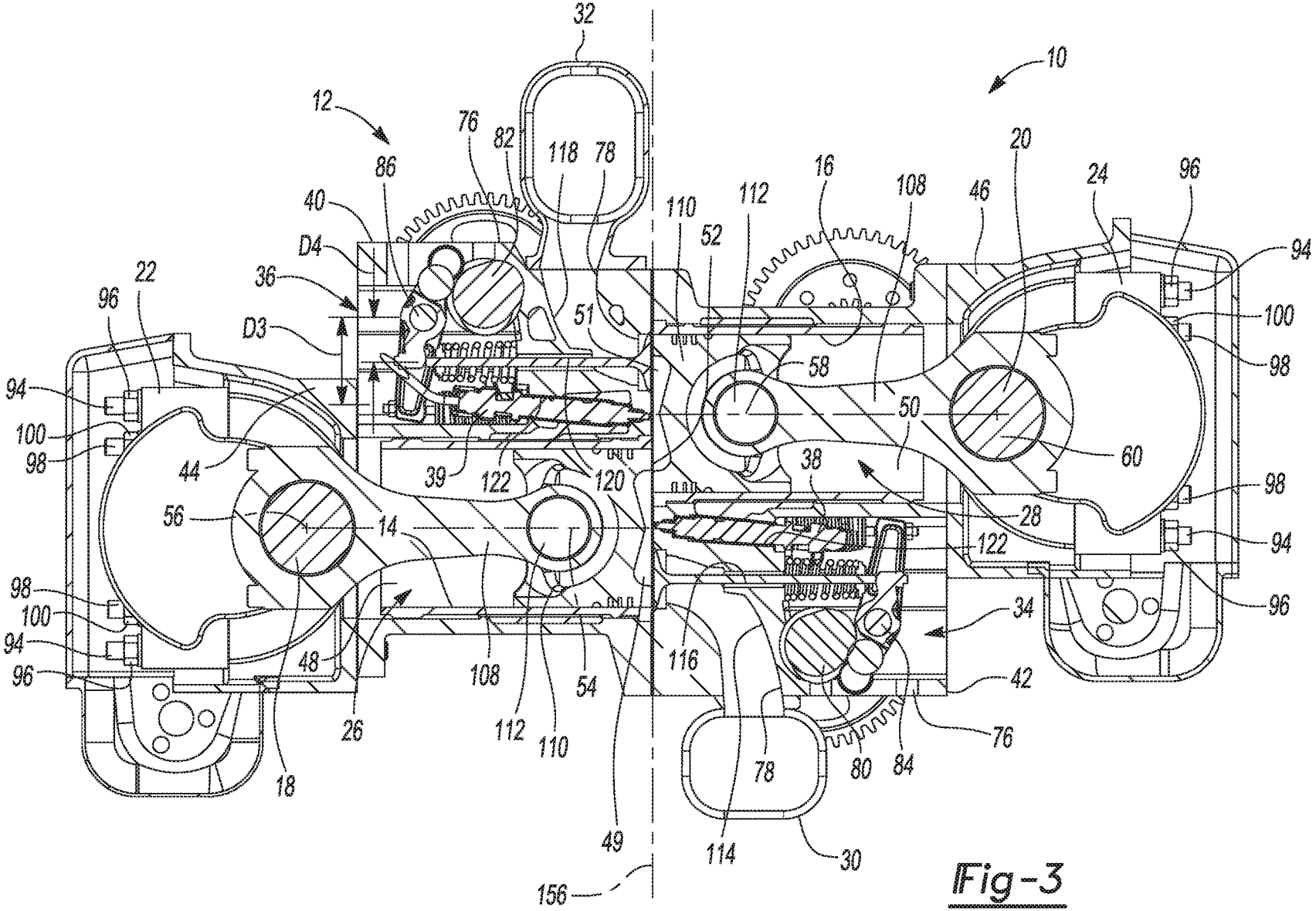
FIG. 3 is a cross-sectional view of the OP4S engine of FIG. 1 taken along a line 3-3 shown in FIG. 1.

Referring now to FIGS. 1-3, an opposed-piston four-stroke (OP4S) engine 10 includes an engine block 12, five pairs of first and second cylinder half liners 14 and 16, first and second crankshafts 18 and 20, first and second crank bearing main caps or saddles 22 and 24, five pairs of first and second pistons 26 and 28, intake and exhaust manifolds 30 and 32, intake and exhaust valve trains 34 and 36, and five pairs of first and second fuel injectors 38 and 39. The engine block 12 includes first and second center sections 40 and 42 and first and second lower crankcases 44 and 46. The first and second center sections 40 and 42 and the first and second lower crankcases 44 and 46 are formed (e.g., cast) separately (e.g., from iron). The first center section 40 defines five pairs of first and second cylinder half bores 48 and 50. Each of the first cylinder half bores 48 is in fluid communication with one of the second cylinder half bores 50 through an opening 52 in the engine block 12. Therefore, each of the pairs of the first and second cylinder half bores 48 and 50 collectively form a single cylinder within which the first and second pistons 26 and 28 reciprocate. In addition, since the OP4S engine 10 includes five pairs of the first and second cylinder half bores 48 and 50, the OP4S engine 10 has five cylinders. However, the OP4S engine 10 may have less than five cylinders (e.g., one cylinder) or more than five cylinders.

Each of the first cylinder half bores 48 has an open end 49, and each of the second cylinder half bores 50 has an open end 51. The open end 51 of each of the second cylinder half bores 50 overlaps the open end 49 of one of the first cylinder half bores 48 to form the opening 52. In this regard, the opening 52 may be defined by the first and second cylinder half liners 14 and 16 rather than the engine block 12.

A longitudinal axis 54 of the first cylinder half bore 48 is disposed within the same plane as a longitudinal axis 56 of the first crankshaft 18. Similarly, a longitudinal axis 58 of the second cylinder half bore 50 is disposed within the same plane as a longitudinal axis 60 of the second crankshaft 20. In addition, the longitudinal axes 54, 58 of the first and second cylinder half bores 48 and 50 are aligned with one another in a longitudinal direction X that is parallel to the longitudinal axes 56, 60 of the first and second crankshafts 18 and 20. Further, the longitudinal axes 54, 58 of the first and second cylinder half bores 48 and 50 are offset from one another in a vertical direction Z to provide packaging space for the intake and exhaust valve trains 34 and 36.

The first and second center sections 40 and 42 are joined to one another using first threaded rods 62, which extend through the first and second center sections 40 and 42 and have first nuts (not shown) threaded onto opposite ends thereof. Each of the first and second center sections 40 and 42 defines a camshaft bore 70, a rocker arm shaft bore 72, a plurality of fastener bores 74, a plurality of valve train openings 76, and a plurality of manifold openings 78. The camshaft bore 70 in the first center section 40 receives an intake camshaft 80 of the intake valve train 34, and the camshaft bore 70 in the second center section 42 receives an exhaust camshaft 82 of the exhaust valve train 36. The rocker arm shaft bore 72 in the first center section 40 receives an intake rocker arm shaft 84 in the intake valve train 34, and the rocker arm shaft bore 72 and the second center section 42 receives an exhaust rocker arm shaft 86 in the exhaust valve train 36.

Each of the valve train openings 76 in the first and second center sections 40 and 42 receives a valve cover (not shown). In addition, the valve train openings 76 in the first and second center sections 40 and 42 can receive fuel lines (not shown) that provide fuel to the first and second fuel injectors 38 and 39. The manifold openings 78 place the intake and exhaust manifolds 30 and 32 in fluid communication with intake and exhaust ports 114 and 118, respectively.

The first crank bearing saddles 22 and the first lower crankcase 44 are joined to the first center section 40 using second threaded rods 94 and second nuts 96 threaded onto the second threaded rods 94. Similarly, the second crank bearing saddles 22 and the second lower crankcase 46 are joined to the second center section 42 using the second threaded rods 94 and the second nuts 96. The first crank bearing saddles 22 are joined to the first lower crankcase 44 using third threaded rods 98 and third nuts 100 threaded onto the third threaded rods 98. Similarly, the second crank bearing saddles 24 are joined to the second lower crankcase 46 using the third threaded rods 98 and the third nuts 100. The first threaded rods 62 have a first length, the second threaded rods 94 have a second length that is less than the first length, and the third threaded rods 98 have a third length that is less than the second length. In various implementations, the second threaded rods 94, the second nuts 96, the third threaded rods 98, and/or the third nuts 100 may be replaced with screws or bolts.

The first crank bearing saddles 22 and the first lower crankcase 44 form a first crankcase assembly, while the second crank bearing saddles 22 and the second lower crankcase 46 form a second crankcase assembly. The first crankshaft 18 is positioned between the first crank bearing saddles 22 and the first lower crankcase 44 before the second and third threaded rods 94 and 98 are inserted through the first crankcase assembly. Thus, the first crankshaft 18 is captured between the first crank bearing saddles 22 and the first lower crankcase 44. Similarly, the second crankshaft 20 is positioned between the second crank bearing saddles 24 and the second lower crankcase 46 before the second and third threaded rods 94 and 98 are inserted through the second crankcase assembly. Thus, the second crankshaft 20 is captured between the second crank bearing saddles 24 and the second lower crankcase 46.

With specific reference to FIG. 3, each first cylinder half liner 14 is placed within one of the first cylinder half bores 48, and each second cylinder half liner 16 is placed within one of the second cylinder half bores 50. Each first piston 26 reciprocates within one of the first cylinder half liners 14, and each second piston 28 reciprocates within one of the second cylinder half liners 16. Each of the first and second pistons 26 and 28 includes a connecting rod 108, a piston head 110, and a wristpin 112. The connecting rod 108 of the first piston 26 connects the piston head 110 of the first piston 26 to the first crankshaft 18. Similarly, the connecting rod 108 of the second piston 28 connects the piston head 110 of the second piston 28 to the second crankshaft 20. The wristpins 112 join the piston heads 110 to the connecting rods 108 while allowing the connecting rods 108 to pivot with respect to the piston heads 110.

The first center section 40 defines the intake ports 114 and intake valve bores 116, the second center section 42 defines the exhaust ports 118 and exhaust valve bores 120, and each of the first and second center sections 40 and 42 defines a fuel injector bore 122. Each of the intake ports 114 is in fluid communication with the intake manifold 30 via the manifold openings 78, and each of the exhaust ports 118 is in fluid communication with the exhaust manifold 32 via the manifold openings 78. Each of the fuel injector bores 122 receives one of the first and second fuel injectors 38 and 39.

Figure 4:
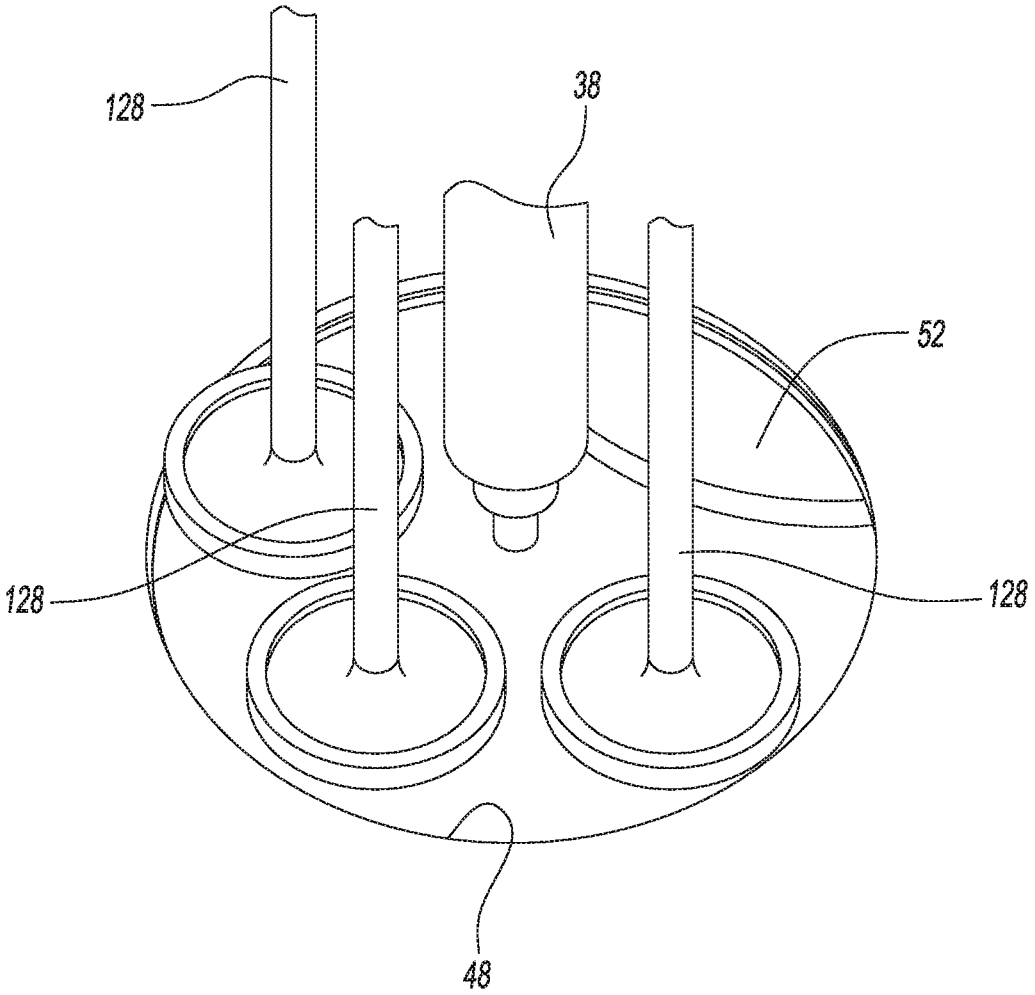
FIG. 4 is a perspective view of a portion of the OP4S engine of FIG. 1 including intake or exhaust valves, a fuel injector, an opening between two cylinder half bores, and an open end of one of the cylinder half bores.

Referring now to FIGS. 4-7, the intake valve train 34 includes the intake camshaft 80, the intake rocker arm shaft 84, first and second intake rocker arms 124 and 126, intake valves 128, and intake rocker arm springs 130. As best shown in FIG. 4, the intake valve train 34 includes three of the intake valves 128 for each of the first cylinder half bores 48. Two of the three intake valves 128 are actuated by two of the first intake rocker arms 124, and one of the thee intake valves 128 is actuated by one of the second intake rocker arms 126. The three intake valves 128 are positioned around the outer perimeter of the corresponding first cylinder half bore 48, which provides space for each first fuel injector 38 and/or a spark plug to be located at or near the longitudinal axis 54 of the corresponding first cylinder half bore 48. Each of the intake valve bores 116 in the first center section 40 receives one of the intake valves 128.

The intake camshaft 80 is driven by the first crankshaft 18. The first intake rocker arms 124 pivot about the intake rocker arm shaft 84 when first rollers 132 on the first intake rocker arms 124 engage first lobes 134 on the intake camshaft 80. Similarly, the second intake rocker arms 126 pivot about the intake rocker arm shaft 84 when second rollers 136 on the second intake rocker arms 126 engage second lobes 138 on the intake camshaft 80. The intake rocker arm springs 130 bias the first and second intake rocker arms 124 and 126 into engagement with the first and second lobes 134 and 138 on the intake camshaft 80. When the first and second intake rocker arms 124 and 126 pivot about the intake rocker arm shaft 84 due to engagement with the first and second lobes 134 and 138 on the intake camshaft 80, the intake valves 128 unseat from the intake ports 114 and move further into the corresponding first cylinder half bore 48. This allows intake air to be drawn into the first cylinder half bore 48 and the corresponding second cylinder half bore 50.

The intake valves 128 actuated by the first intake rocker arms 124 are located a first distance D1 from the intake rocker arm shaft 84, and the intake valves 128 actuated by the second intake rocker arms 126 are located a second distance D2 from the intake rocker arm shaft 84. In addition, the intake rocker arm shaft 84 may extend through the center of gravity of each of the first and second intake rocker arms 124 and 126. Thus, each of the first intake rocker arms 124 has a first length L1 and each of the second intake rocker arms 126 has a second length L2. The second length L2 of each of the second intake rocker arms 126 is less than the first length L1 of each of the first intake rocker arms 124, which allows both the first and second intake rocker arms 124 and 126 to be mounted to the intake rocker arm shaft 84 and to be actuated by the intake camshaft 80. In other words, the difference between the first and second length L1 and L2 of the first and second intake rocker arms 124 and 126 enables the first and second intake rocker arms 124 and 126 to be mounted to a common rocker pivot shaft and to be actuated by a single camshaft. The difference between the first and second lengths L1 and L2 may be two times the difference between the first and second distances D1 and D2.

The difference between the first and second lengths L1 and L2 of the first and second intake rocker arms 124 and 126 enables the intake valves 128 actuated by the first and second intake rocker arms 124 and 126 to be located at the different distances D1 and D2 from the intake rocker arm shaft 84. Thus, the difference between the first and second lengths L1 and L2 of the first and second intake rocker arms 124 and 126 makes it possible to arrange three or more of the intake valves 128 around the outer perimeter of each first cylinder half bore 48 as shown in FIG. 4 without mounting the first and second intake rocker arms 124 and 126 to different rocker arm shafts. As a result, the volumetric efficiency of the OP4S engine 10 is improved relative to OP4S engines that have a fewer number of intake valves per cylinder. To this end, a cylinder having three intake valves arranged as shown in FIG. 4 may have 30 percent more available area for intake air to flow through relative to a cylinder that only has two intake valves. In addition, the packaging space required by the intake valve train 34 is less compared to intake valve trains that have multiple rocker arm shafts. Further, the stems of the intake valves 128 can be oriented parallel to the longitudinal axis 54 of the first cylinder half bore 48 (e.g., when the OP4S engine 10 is a compression-ignition engine) or inclined relative to the longitudinal axis 54 (when the OP4S engine 10 is a spark-ignition engine).

In addition, the intake valves 128 actuated by the first and second intake rocker arms 124 and 126 may have different lever ratios so that all of the intake valves 128 have the same lift profile despite the difference between the first and second lengths L1 and L2. A lever ratio of an intake or exhaust valve is a ratio of cam lobe lift to valve lift. The intake valves 128 actuated by the first intake rocker arms 124 may have a first lever ratio between 1.5 and 2 (e.g., 1.75), and the intake valves 128 actuated by the second intake rocker arms 126 may have a second lever ratio between 1 and 1.5 (e.g., 1.1). Further, to achieve these different lever ratios, the first and second lobes 134 and 138 on the intake camshaft 80 may have different outer profiles. For example, the first lobes 134 on the intake camshaft 80 may have a first height H1, and the second lobes 138 on the intake camshaft 80 may have a second height H2 that is greater than the first height H1.

The exhaust valve train 36 includes the exhaust camshaft 82, the exhaust rocker arm shaft 86, first and second exhaust rocker arms 140 and 142, exhaust valves 144, and exhaust rocker arm springs 146. The exhaust valve train 36 includes three of the exhaust valves 144 for each of the second cylinder half bores 50. Two of the three exhaust valves 144 are actuated by two of the first exhaust rocker arms 140, and one of the three exhaust valves 144 is actuated by one of the second exhaust rocker arms 142. The three exhaust valves 144 are positioned around one of the second fuel injectors 39 similar to the way in which three of the intake valves 128 are positioned around one of the first fuel injectors 38 in FIG. 4. Each second fuel injector 39 is located at or near the longitudinal axis 56 of the corresponding second cylinder half bore 50, and three of the exhaust valves 144 are positioned around each second fuel injector 39 along the outer perimeter of the corresponding second cylinder half bore 50. Each of the exhaust valve bores 120 in the second center section 42 receives one of the exhaust valves 144.

The exhaust camshaft 82 is driven by the second crankshaft 20. The first exhaust rocker arms 140 pivot about the exhaust rocker arm shaft 86 when first rollers 148 on the first exhaust rocker arms 140 engage first lobes 150 on the exhaust camshaft 82. Similarly, the second exhaust rocker arms 142 pivot about the exhaust rocker arm shaft 86 when second rollers 152 on the second exhaust rocker arms 142 engage second lobes 154 on the exhaust camshaft 82. The exhaust rocker arm springs 146 bias the first and second exhaust rocker arms 140 and 142 into engagement with the first and second lobes 150 and 154 on the exhaust camshaft 82. When the first and second exhaust rocker arms 140 and 142 pivot about the exhaust rocker arm shaft 86 due to engagement with the first and second lobes 150 and 154 on the exhaust camshaft 82, the exhaust valves 144 unseat from the exhaust ports 118 and move further into the corresponding second cylinder half bore 50. This allows exhaust gas to be expelled from the first and second cylinder half bores 48 and 50.

The exhaust valves 144 actuated by the first exhaust rocker arms 140 are located a third distance D3 (FIG. 3) from the intake rocker arm shaft 84, and the exhaust valves 144 actuated by the second exhaust rocker arms 142 are located a fourth distance D4 (FIG. 3) from the exhaust rocker arm shaft 86. In addition, the exhaust rocker arm shaft 86 may extend through the center of gravity of each of the first and second exhaust rocker arms 140 and 142. Thus, each of the first exhaust rocker arms 140 has a third length L3 and each of the second exhaust rocker arms 142 has a fourth length L4. The fourth length L4 of each of the second exhaust rocker arms 142 is less than the third length L3 of each of the first exhaust rocker arms 140, which allows both the first and second exhaust rocker arms 140 and 142 to be mounted to the exhaust rocker arm shaft 86 and to be actuated by the exhaust camshaft 82. In other words, the difference between the third and fourth length L3 and L4 of the first and second exhaust rocker arms 140 and 142 enables the first and second exhaust rocker arms 140 and 142 to be mounted to a common rocker pivot shaft and to be actuated by a single camshaft. The difference between the third and fourth length L3 and L4 may be two times the difference between the third and fourth distances D3 and D4.

The difference between the third and fourth length L3 and L4 of the first and second exhaust rocker arms 140 and 142 enables the exhaust valves 144 actuated by the first and second exhaust rocker arms 140 and 142 to be located at the different distances D3 and D4 from the exhaust rocker arm shaft 86. Thus, the difference between the third and fourth length L3 and L4 of the first and second exhaust rocker arms 140 and 142 makes it possible to arrange three or more of the exhaust valves 144 around each second cylinder half bore 50 similar to the arrangement of FIG. 4 without mounting the first and second exhaust rocker arms 140 and 142 to different rocker arm shafts. As a result, the volumetric efficiency of the OP4S engine 10 is improved relative to OP4S engines that have a fewer number of exhaust valves per cylinder. To this end, a cylinder having three exhaust valves arranged as shown in FIG. 4 may have 30 percent more available area for exhaust gas to flow through relative to a cylinder that only has two exhaust valves. In addition, the packaging space required by the exhaust valve train 36 is less compared to exhaust valve trains that have multiple rocker arm shafts. Further, the stems of the exhaust valves 144 can be oriented parallel to the longitudinal axis 58 of the second cylinder half bore 50 (e.g., when the OP4S engine 10 is a compression-ignition engine) or inclined relative to the longitudinal axis 58 (when the OP4S engine 10 is a spark-ignition engine).

The exhaust valves 144 actuated by the first and second exhaust rocker arms 140 and 142 may have different lever ratios so that all of the exhaust valves 144 have the same lift profile despite the difference between the third and fourth length L3 and L4. The exhaust valves 144 actuated by the first exhaust rocker arms 140 may have a third lever ratio between 1.5 and 2 (e.g., 1.75), and the exhaust valves 144 actuated by the second exhaust rocker arms 142 may have a fourth lever ratio between 1 and 1.5 (e.g., 1.1). In addition, to achieve these different lever ratios, the first and second lobes 150 and 154 on the exhaust camshaft 82 may have different outer profiles. For example, the heights of the first and second lobes 150 and 154 on the exhaust camshaft 82 may differ just as the heights of the first and second lobes 134 and 138 on the intake camshaft 80 may differ.

Figure 5:
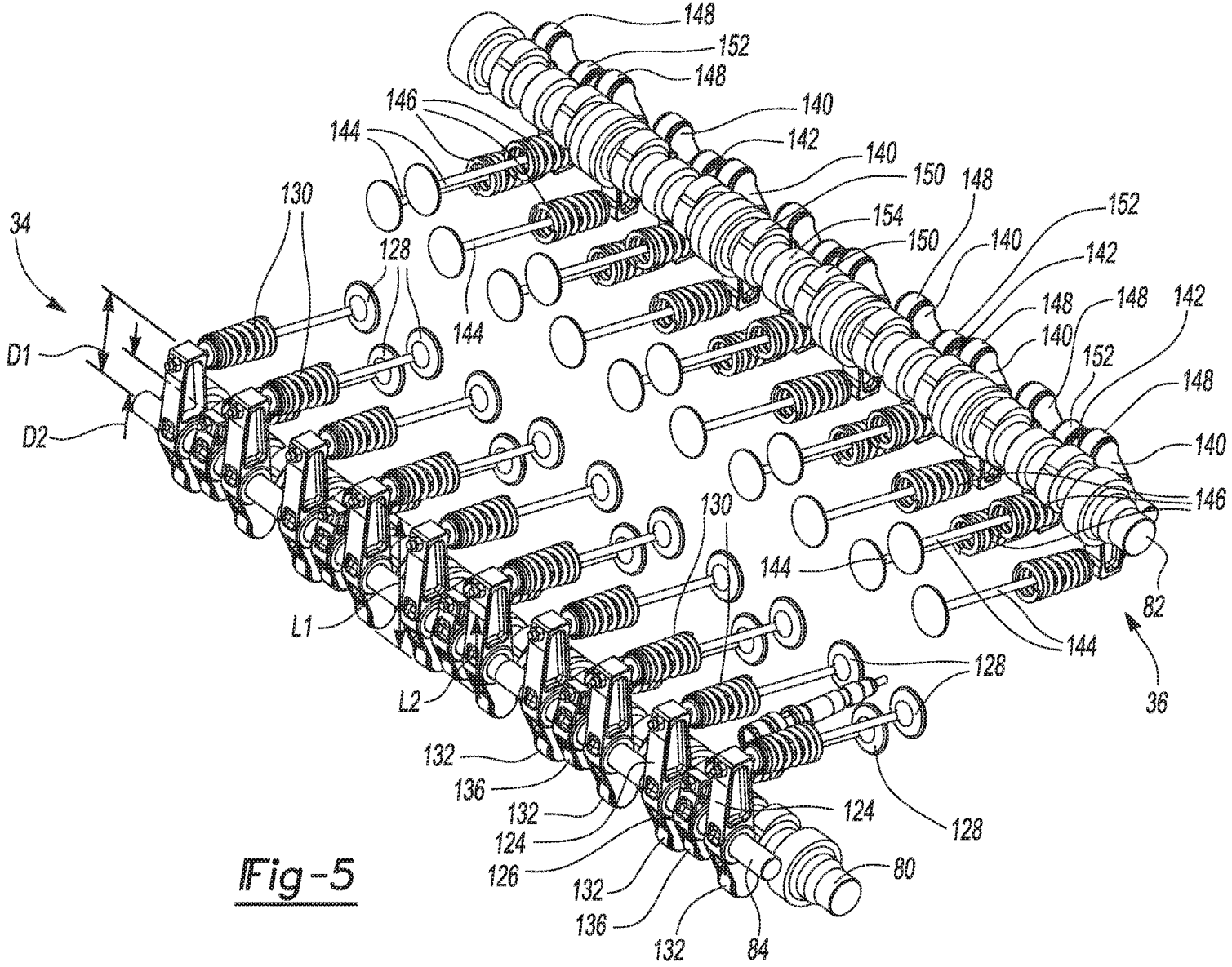
FIG. 5 is perspective views of the valve train included in the OP4S engine of FIG. 1.
Figure 6:
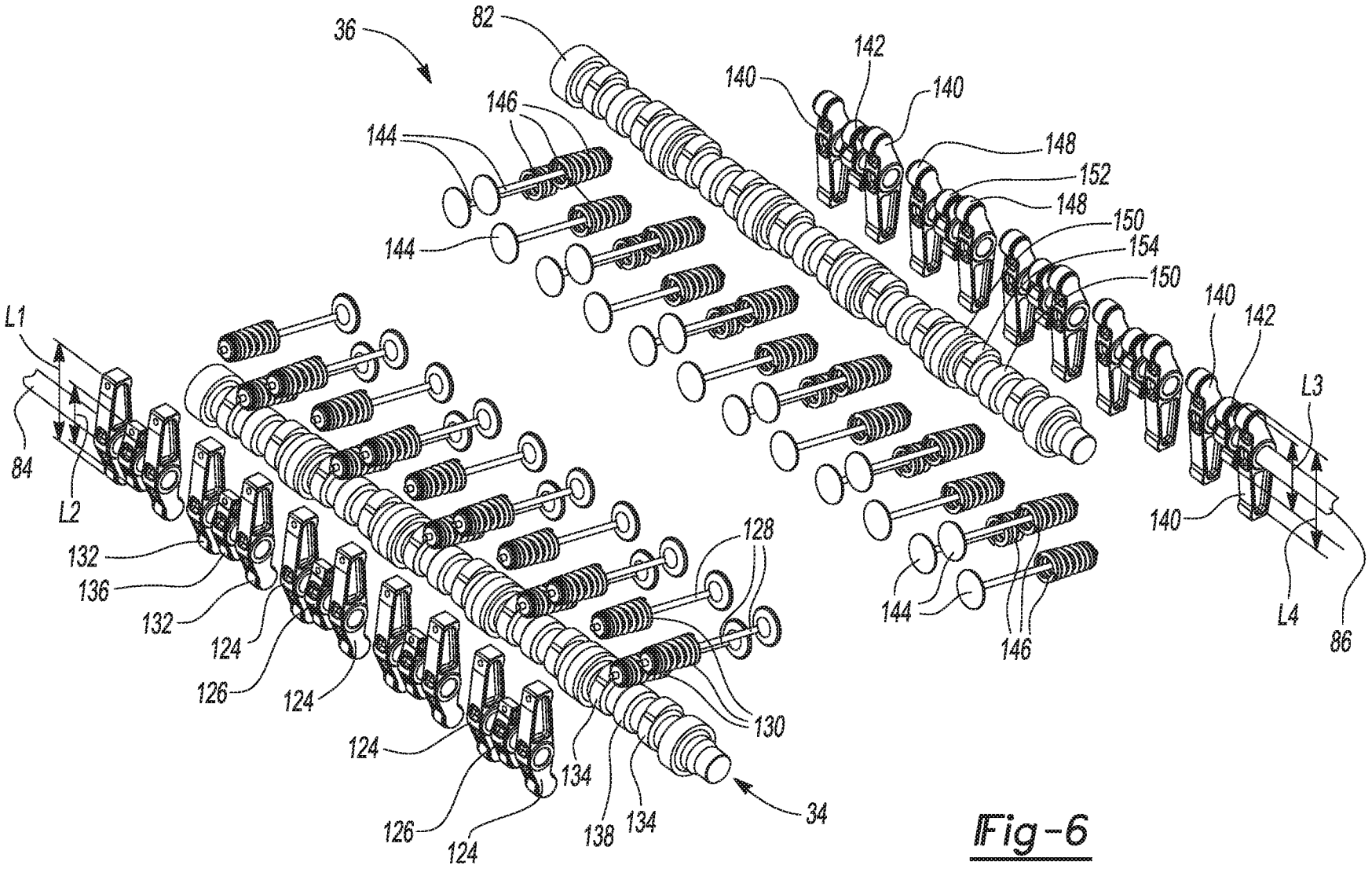
FIG. 6 is an exploded perspective view of the valve train included in the OP4S engine of FIG. 1.
Figure 7:
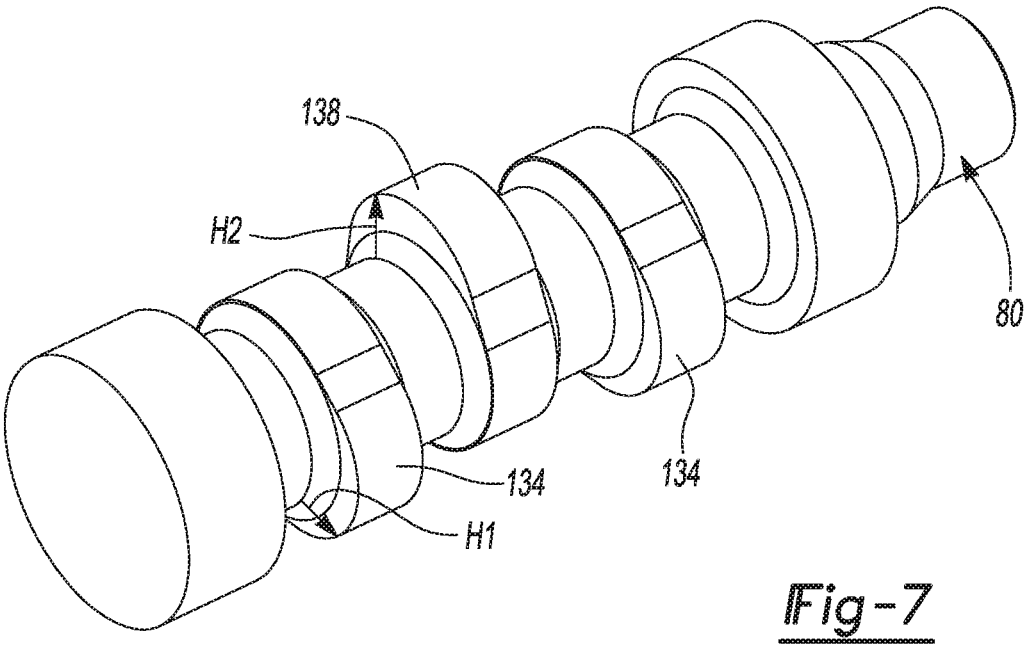
FIG. 7 is a perspective view of a portion of a camshaft included in the valve train of the OP4S engine of FIG. 1.

Referring now to FIGS. 3 and 5, all of the intake valves 128 are arranged on one side of a centerline 156 of the OP4S engine 10, and all of the exhaust valves 144 are arranged on the other side of the centerline 156. This arrangement improves the flow of intake air and exhaust gas through cylinders of the OP4S engine 10, and reduces the complexity of the OP4S engine 10 relative to an engine that has both intake and exhaust valves arranged on one side thereof. To this end, an engine that has both intake and exhaust valves arranged on one side thereof required both intake and exhaust runners to be routed to that side. In contrast, the OP4S engine 10 only requires one of an intake runner or an exhaust runner to be routed to each side thereof.

Referring again to FIGS. 1-3, the OP4S engine 10 further includes a gear train 158, a turbocharger 160, an intake line 162, a first side cover 164, a second side cover 166, a first end cover 168, and a second end cover (not shown). The gear train 158 includes first and second crankshaft gears 170 and 172, first and second camshaft gears 174 and 176, first and second idler gears 178 and 180, an output shaft gear 182, a fuel pump gear 184, and oil scavenge pump gears 186. The first and second crankshaft gears 170 and 172 are coupled to the first and second crankshafts 18 and 20, respectively. The first and second camshaft gears 174 and 176 are coupled to the intake and exhaust camshafts 80 and 82, respectively. The output shaft gear 182, the fuel pump gear 184, and the oil scavenge pump gears 186 may be coupled to an output shaft (not shown), a fuel pump (not shown), and oil scavenge pumps (not shown), respectively.

The first and second idler gears 178 and 180 connect the first and second crankshaft gears 170 and 172 to the first and second camshaft gears 174 and 176 and the output shaft gear 182. Each of the first idler gears 178 is engaged with one of the first and second crankshaft gears 170 and 172, one of the second idler gears 180, and the output shaft gear 182. Each of the second idler gears 180 is engaged with one of the first idler gears 178 and one of the first and second camshaft gears 174 and 176. Thus, the first and second crankshafts 18 and 20 drive the intake and exhaust camshafts 80 and 82 via the gear train 158. In various implementations, the first and second crankshafts 18 and 20 may drive the intake and exhaust camshafts 80 and 82 using mechanisms other than gears, such as belts or chains.

The turbocharger 160 is fluidly coupled to the exhaust manifold 32 and is driven by exhaust gases flowing through the exhaust manifold 32. The turbocharger 160 compresses intake air and provides the compressed intake air to the intake manifold 30 via the intake line 162. The first side cover 164 encases one side of the OP4S engine 10, and the second side cover 166 encases the other side of the OP4S engine 10. The first end cover 168 encases one end of the OP4S engine 10, and the second end cover encases the other end of the OP4S engine 10.

With continued reference to FIGS. 1-3, operation of the OP4S engine 10 will now be described. As its name indicates, the OP4S engine 10 operates using four strokes—an intake stroke, a compression stroke, a power stroke, and an exhaust stroke. During the intake stroke, the intake valves 128 are open (i.e., unseated from the intake ports 114), and the first and second pistons 26 and 28 move from the positions shown in FIG. 4 in a direction away from each other. The motion of the first and second pistons 26 and 28 creates a vacuum that draws intake air through the intake ports 114 and into the first and second cylinder half bores 48 and 50. In addition, the first and second fuel injectors 38 and 39 may inject fuel into the first and second cylinder half bores 48 and 50, respectively, to yield an air-fuel mixture.

During the compression stroke, the intake valves 128 are closed (i.e., seated against the intake ports 114), and the first and second pistons 26 and 28 move toward one another to the positions shown in FIG. 4, which are commonly referred to as top dead center. When the first and second pistons 26 and 28 are near top and center, the pressure within the first and second cylinder half bores 48 and 50 causes the air-fuel mixture to ignite (i.e., if the OP4S engine 10 is a compression-ignition engine) or a spark produced by a spark plug (not shown) causes the air-fuel mixture to ignite (i.e., if the OP4S engine 10 is a spark-ignition engine). During the power stroke, a rapid pressure increase within the first and second cylinder half bores 48 and 50 resulting from combustion of the air-fuel mixture causes the first and second pistons 26 and 28 to move away from one another. As the first and second pistons 26 and 28 move away from one another, the first and second pistons 26 and 28 drive the first and second crankshaft 18 and 20, respectively.

During the exhaust stroke, the exhaust valves are open (i.e., unseated from the exhaust ports 118), and the first and second pistons 26 and 28 move toward each other to the positions shown in FIG. 4. The motion of the first and second pistons 26 and 28 increases the pressure within the first and second cylinder half bores 48 and 50, which forces exhaust gas out of the first and second cylinder half bores 48 and 50 through the exhaust ports 118. A gasket 188 seals the interface between the first and second center sections 40 and 42 to prevent exhaust gas from escaping the first and second cylinder half bores 48 and 50 through a path other than the exhaust ports 118.

Figure 8:
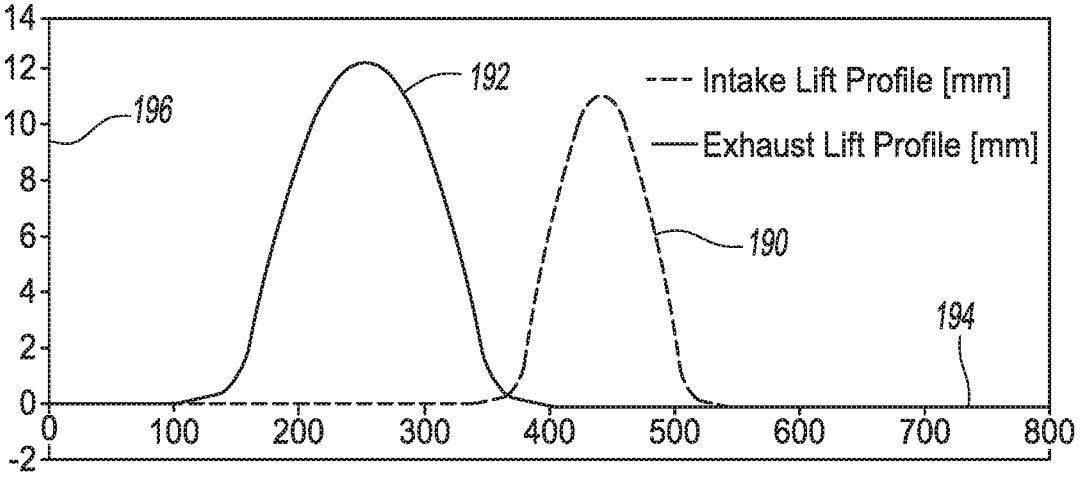
FIG. 8 is a graph illustrating lift profiles of intake and exhaust valves in the valve train included in the OP4S engine of FIG. 1.

Referring now to FIG. 8, an intake lift profile 190 and an exhaust lift profile 192 are plotted with respect to an x-axis 194 that represents crank angle in degrees and a y-axis 196 that represents valve lift in millimeters. As shown in FIG. 8, the intake lift profile 190 is different than the exhaust lift profile 192. However, the intake valves 128 actuated by the first intake rocker arms 124 and the intake valves 128 actuated by the second intake rocker arms 126 may both have the intake lift profile 190. Similarly, the exhaust valves 144 actuated by the first exhaust rocker arms 140 and the exhaust valves 144 actuated by the second exhaust rocker arms 142 may both have the exhaust lift profile 192. The difference between the lever ratios of the first and second intake rocker arms 124 and 126 enables all of the intake valves 128 to have the same lift profile despite the difference between the lengths of the first and second intake rocker arms 124 and 126. Similarly, the difference between the lever ratios of the first and second exhaust rocker arms 142 and 144 enables all of the exhaust valves 144 to have the same lift profile despite the difference between the lengths of the first and second intake rocker arms 124 and 126.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

What is claimed is:

1. An opposed-piston engine comprising:

an engine block including a first center section and a second center section, the first center section defining a first cylinder half bore having a first longitudinal axis and a first open end, the second center section defining a second cylinder half bore having a second longitudinal axis and a second open end, the second longitudinal axis of the second cylinder half bore being offset from the first longitudinal axis of the first cylinder half bore, the second open end of the second cylinder half bore overlapping the first open end of the first cylinder half bore to form an opening between the first and second cylinder half bores, the opening placing the first and second cylinder half bores in fluid communication with one another to form a single cylinder;

at least three intake valves having the same lift profile arranged at the first open end of the first cylinder half bore;

at least three exhaust valves having the same lift profile arranged at the second open end of the second cylinder half bore;

an intake camshaft that actuates the at least three intake valves;

an exhaust camshaft that actuates the at least three exhaust valves;

an intake rocker arm shaft;

first intake rocker arms pivotally mounted on the intake rocker arm shaft and configured to open first and second ones of the intake valves when the first intake rocker arms engage first lobes on the intake camshaft, the first and second intake valves located a first distance from the intake rocker arm shaft;

a second intake rocker arm pivotally mounted on the intake rocker arm shaft and configured to open a third one of the intake valves when the second intake rocker arm engages a second lobe on the intake camshaft, the third intake valve located a second distance from the intake rocker arm shaft that is different than the first distance;

an exhaust rocker arm shaft;

first exhaust rocker arms pivotally mounted on the exhaust rocker arm shaft and configured to open first and second ones of the exhaust valves when the first exhaust rocker arms engage first lobes on the exhaust camshaft, the first and second exhaust valves located a third distance from the exhaust rocker arm shaft; and a second exhaust rocker arm pivotally mounted on the exhaust rocker arm shaft and configured to open a third one of the exhaust valves when the second exhaust rocker arm engages a second lobe on the exhaust camshaft, the third exhaust valve located a fourth distance from the exhaust rocker arm shaft that is different than the third distance.

2. The opposed-piston engine of claim 1 wherein the size of each of the exhaust valves is equal to the size of each of the intake valves.

3. The opposed-piston engine of claim 1 wherein:

the second distance is less than the first distance; and the fourth distance is less than the third distance.

4. The opposed-piston engine of claim 3 wherein:

each of the first intake rocker arms has a first length;

the second intake rocker arm has a second length that is less than the first length of each of the first intake rocker arms;

each of the first exhaust rocker arms has a third length; and the second exhaust rocker arm has a fourth length that is less than the third length of each of the first exhaust rocker arms.

5. The opposed-piston engine of claim 3 wherein:

each of the first lobes on the intake camshaft has a first height;

the second lobe on the intake camshaft has a second height that is greater than the first height;

each of the first lobes on the exhaust camshaft has a third height; and the second lobe on the exhaust camshaft has a fourth height that is greater than the third height.

6. The opposed-piston engine of claim 1 wherein:

the intake valves include stems that are oriented parallel to the first longitudinal axis of the first cylinder half bore; and the exhaust valves include stems that are oriented parallel to the second longitudinal axis of the second cylinder half bore.

7. The opposed-piston engine of claim 1 further comprising:

a first fuel injector positioned at or near the first longitudinal axis of the first cylinder half bore, wherein the intake valves are positioned around the first fuel injector along an outer perimeter of the first cylinder half bore; and a second fuel injector positioned at or near the first longitudinal axis of the second cylinder half bore, wherein the exhaust valves are positioned around the second fuel injector along an outer perimeter of the second cylinder half bore.

8. The opposed-piston engine of claim 1 wherein the first and second center sections are formed separate from one another.

9. An opposed-piston engine comprising:

an engine block including a first center section and a second center section, the first center section defining a first cylinder half bore having a first longitudinal axis and a first open end, the second center section defining a second cylinder half bore having a second longitudinal axis and a second open end, the second longitudinal axis of the second cylinder half bore being offset from the first longitudinal axis of the first cylinder half bore, the second open end of the second cylinder half bore overlapping the first open end of the first cylinder half bore to form an opening between the first and second cylinder half bores, the opening placing the first and second cylinder half bores in fluid communication with one another to form a single cylinder;

a plurality of intake valves arranged at the first open end of the first cylinder half bore and configured to control the flow of intake air into the cylinder;

a plurality of exhaust valves arranged at the second open end of the second cylinder half and configured to control the flow of exhaust gas out of the cylinder;

an intake rocker arm shaft;

first intake rocker arms pivotally mounted on the intake rocker arm shaft and configured to open first and second ones of the intake valves, the first and second intake valves located a first distance from the intake rocker arm shaft;

a second intake rocker arm pivotally mounted on the intake rocker arm shaft and configured to open a third one of the intake valves, the third intake valve located a second distance from the intake rocker arm shaft that is different than the first distance;

an exhaust rocker arm shaft;

first exhaust rocker arms pivotally mounted on the exhaust rocker arm shaft and configured to open first and second ones of the exhaust valves, the first and second exhaust valves located a third distance from the exhaust rocker arm shaft; and a second exhaust rocker arm pivotally mounted on the exhaust rocker arm shaft and configured to open a third one of the exhaust valves, the third exhaust valve located a fourth distance from the exhaust rocker arm shaft that is different than the third distance.

10. The opposed-piston engine of claim 9 wherein the plurality of intake valves includes three intake valves and the plurality of exhaust valves includes three exhaust valves.

11. The opposed-piston engine of claim 9 wherein the size of each of the exhaust valves is equal to the size of each of the intake valves.

12. The opposed-piston engine of claim 9 further comprising:

a single intake camshaft that actuates all of the intake valves; and a single exhaust camshaft that actuates all of the exhaust valves.

* * * * *